US011745995B1

(12) United States Patent
Freeman et al.

(10) Patent No.: US 11,745,995 B1
(45) Date of Patent: Sep. 5, 2023

(54) INGREDIENT CARTRIDGE LOADER FOR A FLUID MIXTURE DISPENSING DEVICE

(71) Applicant: Cana Technology, Inc., Redwood City, CA (US)

(72) Inventors: Josh Freeman, San Francisco, CA (US); Gregory Allen Springer, Los Altos, CA (US); Erik Christensen, Modesto, CA (US); Alan Crarer, Santa Cruz, CA (US); Andrew Scott Davies, Oakland, CA (US); Kristopher Bernardo Dos Santos, San Francisco, CA (US); Matthew Ambauen, San Francisco, CA (US); Simon Korazija, Heidenheim (DE); Niall Macken, Santa Cruz, CA (US); Bret Lobree, Berkeley, CA (US); Elijah S. Kashi, San Francisco, CA (US)

(73) Assignee: Cana Technology, Inc., Redwood City, CA (US)

( * ) Notice: Subject to any disclaimer, the term of this patent is extended or adjusted under 35 U.S.C. 154(b) by 0 days.

(21) Appl. No.: 17/685,108

(22) Filed: Mar. 2, 2022

(51) Int. Cl.

| | |
|---|---|
| ***B67D 1/00*** | (2006.01) |
| ***B65B 3/04*** | (2006.01) |
| ***B65D 75/58*** | (2006.01) |
| ***B67D 1/08*** | (2006.01) |
| ***B67D 1/12*** | (2006.01) |

(52) U.S. Cl.
CPC ..... *B67D 1/0037* (2013.01); *B65B 3/045* (2013.01); *B65D 75/5872* (2013.01); *B67D 1/0031* (2013.01); *B67D 1/0048* (2013.01); *B67D 1/0079* (2013.01); *B67D 1/0888* (2013.01); *B67D 1/1231* (2013.01); *B67D 1/1243* (2013.01); *B67D 2001/082* (2013.01)

(58) Field of Classification Search
CPC .. B67D 1/0037; B67D 1/0031; B67D 1/0048; B67D 1/0079; B67D 1/0888; B67D 1/1231; B67D 1/1243; B67D 2001/082; B65B 3/045; B65D 75/5872
See application file for complete search history.

(56) References Cited

U.S. PATENT DOCUMENTS 2,451,195 A * 10/1948 Brown ..... A47J 31/3657 99/305
3,213,777 A * 10/1965 Heier ..... A47J 31/3657 99/302 R
6,079,315 A * 6/2000 Beaulieu ..... A47J 31/4467 99/302 R (Continued)

OTHER PUBLICATIONS

International Search Report and Written Opinion dated Jun. 26, 2023 from PCT Application No. PCT/US2023/014004, 19 pages.

*Primary Examiner* — Donnell A Long
(74) *Attorney, Agent, or Firm* — Daylight Law, P.C.

(57) ABSTRACT

Cartridge loaders for fluid mixture dispensing systems are disclosed. One disclosed fluid mixture dispensing system comprises an interface surface, a cartridge receiver carriage, and an actuator configured to depress the cartridge receiver carriage towards the interface surface to load a cartridge. The fluid mixture dispensing system is configured to apply continuous downward pressure on the cartridge towards the interface surface when the cartridge is loaded and is in contact with the interface surface.

34 Claims, 8 Drawing Sheets

(56) References Cited

U.S. PATENT DOCUMENTS

| | | | | |
|---|---|---|---|---|
| 6,142,063 | A * | 11/2000 | Beaulieu | A47J 31/3623 99/302 R |
| 8,505,595 | B2 | 8/2013 | Bragg et al. | |
| 9,155,417 | B2 | 10/2015 | Girard et al. | |
| 9,394,154 | B2 | 7/2016 | Connerat et al. | |
| 10,150,663 | B2 | 12/2018 | Seay et al. | |
| 10,624,489 | B2 | 4/2020 | Denisart et al. | |
| 2002/0148356 | A1* | 10/2002 | Lazaris | A47J 31/3638 99/302 R |
| 2003/0194200 | A1 | 10/2003 | Yuen et al. | |
| 2004/0188459 | A1* | 9/2004 | Halliday | A47J 31/3695 222/83 |
| 2009/0007792 | A1* | 1/2009 | Glucksman | A47J 31/4407 99/287 |
| 2010/0147414 | A1 | 6/2010 | Nighy et al. | |
| 2012/0321756 | A1* | 12/2012 | Estabrook | B65D 81/3205 426/115 |
| 2015/0164262 | A1 | 6/2015 | Dingle et al. | |
| 2021/0087045 | A1 | 3/2021 | Carignan et al. | |
| 2021/0094819 | A1* | 4/2021 | Lundberg | B01F 35/42 |
| 2021/0307555 | A1 | 10/2021 | Melville, Jr. et al. | |

* cited by examiner

INGREDIENT CARTRIDGE LOADER FOR A FLUID MIXTURE DISPENSING DEVICE

BACKGROUND

Fluid dispensing devices are widely used for various purposes. Some types of fluid dispensing devices are designed to dispense a single fluid, while others can dispense more than one. The one or more fluids can be prestored in containers within the device or can be mixed in the device on demand. In either case, fluid dispensing devices can utilize packages of individual ingredients or more complex mixtures as the source of the dispensed fluids. For example, a traditional soda fountain includes different flavored syrups that are individually packaged and then individually mixed with carbonated water on demand. As another example, some coffee makers include flavor pods that are loaded into the device and are then mixed with hot water by the device to make coffee. While an at home coffee maker and commercial soda fountain are disparate applications, they both share the common feature of utilizing packaged ingredients that are designed to be installed into and interface with the device to dispense fluids with desired characteristics. Packaging methods and systems that allow such ingredients to be stored, shipped, and dispensed effectively represent an important area for technical development in the field of fluid dispensing devices. The associated mechanisms that interface with the packages are likewise important.

SUMMARY

This disclosure relates generally to fluid mixture dispensing devices and methods, and more specifically, to cartridge loaders for fluid mixture dispensing devices.

Cartridge loaders are described herein for cartridges with one or more ingredient reservoirs storing ingredients that are dispensed out of a bottom side of the cartridge. The cartridges can be designed to interface with one or more actuators that apply pressure to the cartridge to control the dispensing of the liquid ingredients from the one or more ingredient reservoirs via one or more orifices on the cartridge. The cartridge loaders can be designed to receive a cartridge and install the cartridge appropriately so that the ingredients can be efficiently dispensed from the cartridge.

Specific cartridge loaders disclosed herein can receive a cartridge, install the cartridge, and continue to apply downward pressure on the cartridge when the cartridge is loaded. The pressure can be applied through an electromechanical actuator, a mechanical actuator, or the compression fit of a socket into which the cartridge has been forced. As will be described in the detailed description below, in specific embodiments of the invention, the continuous downward pressure can exceed the weight of the cartridge, when full, and can assure an accurate dispensing of the ingredients. Numerous other features regarding the disclosed cartridge loaders will be apparent from the detailed description below.

In specific embodiments of the invention, a fluid mixture dispensing system is provided. The fluid mixture dispensing system comprises an interface surface, a cartridge receiver carriage, and an actuator configured to depress the cartridge receiver carriage towards the interface surface to load a cartridge. The fluid mixture dispensing system is configured to apply continuous downward pressure on the cartridge towards the interface surface when the cartridge is loaded and is in contact with the interface surface.

In specific embodiments of the invention, a method of loading a cartridge in a fluid mixture dispensing device is provided. The method comprises receiving the cartridge in a cartridge receiver carriage of the fluid mixture dispensing device, depressing the cartridge receiver carriage towards an interface surface of the fluid mixture dispensing device to load the cartridge, and applying continuous downward pressure on the cartridge towards the interface surface when the cartridge is loaded and in contact with the interface surface.

In specific embodiments of the invention, a fluid mixture dispensing system is provided. The fluid mixture dispensing system comprises an interface surface, a cartridge receiver slot for a cartridge loader, an actuator configured to depress a cartridge towards the interface surface to load the cartridge after the cartridge is inserted into the cartridge receiver slot, a movable cover for the cartridge receiver slot, and a fluid path from the cartridge to an output of the fluid mixture dispensing system. The movable cover includes at least a portion of the fluid path.

BRIEF DESCRIPTION OF THE DRAWINGS

In the Figures, like reference numbers correspond to like components unless otherwise stated.

DETAILED DESCRIPTION

Different components and methods associated with fluid mixture dispensing device cartridge loaders will be described in detail in this disclosure. The methods and systems disclosed in this section are nonlimiting embodiments of the invention, are provided for explanatory purposes only, and should not be used to constrict the full scope of the invention. It is to be understood that the disclosed embodiments may or may not overlap with each other. Thus, part of one embodiment, or specific embodiments thereof, may or may not fall within the ambit of another, or specific embodiments thereof, and vice versa. Different embodiments from different aspects may be combined or practiced separately. Many different combinations and sub-combinations of the representative embodiments shown within the broad framework of this invention, that may be apparent to those skilled in the art but not explicitly shown or described, should not be construed as precluded.

Figure 1A:
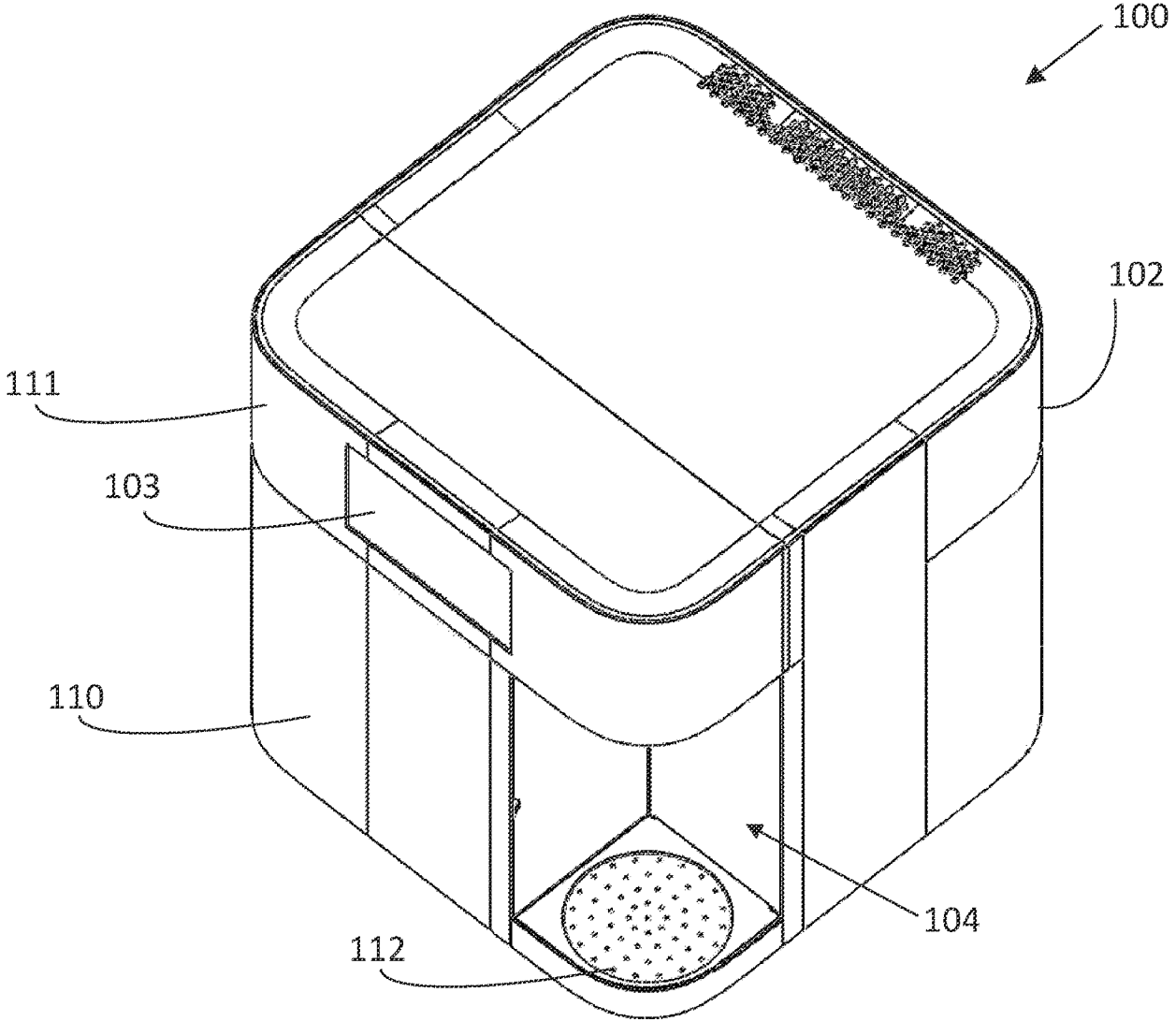
FIG. 1A illustrates an example of a fluid mixture dispensing device, in accordance with specific embodiments disclosed herein.

FIG. 1A illustrates an example of a fluid mixture dispensing device 100, in accordance with specific embodiments disclosed herein. The fluid mixture dispensing device 100 can exhibit the characteristics of any of the fluid mixture dispensing devices described in U.S. Provisional Patent Application No. 63/146,461 filed Feb. 5, 2021, and U.S. patent application Ser. No. 17/547,081 filed Dec. 9, 2021, all of which are incorporated by reference herein in their entirety for all purposes.

The fluid mixture dispensing device 100 can include a casing, such as casing 102, that can house various internal components of the device. The casing 102 can include various accesses to the interior of the device. The accesses can be in the form of doors, such as upper access door 111 and lower access door 110. The accesses can also be removable portions, such as lids or walls of the casing. The accesses can be configured so that a user of the device can access at least part of the interior of the device, for example to replace a component, to clean the device, etc., as will be described below in more detail.

The fluid mixture dispensing device can also include a user interface, such as user interface 103. The user interface 103 can include any means for outputting information from the device to a user of the device, and for inputting information from the user of the device to the device. In this way, the user interface can include any means that facilitate the interaction of a user of the device with the device, including but not limited to a display, a speaker, a microphone, a camera, various sensors such as light and presence sensors, etc. For example, the user interface can include a touch screen display, so that the device can display information for the user via the display, and the user can provide inputs to the device via the touch screen display. As another example, the interaction between the user and the device can be via auditory cues provided by the device via a speaker and voice commands from the user received via a microphone. As another example, the device can recognize user facial expressions and gestures via cameras and sensors. The user interface components can be associated to a controller of the device so that the controller can administrate the information to be outputted and process the information being received.

The fluid mixture dispensing device 100 can also include a dispense area, such as dispense area 104. Dispense area 104 can be the area where a fluid mixture is dispensed out of the device 100. Dispense area 104 can be an area configured to receive a vessel or other containers to dispense a fluid mixture out of device 100. The dispense area 104 can be sized so that different containers (for example a wine glass) can be placed therein. The dispense area 104 can include a waste outlet, such as waste outlet 112. The waste outlet can be a removable waste outlet, such as a removable drip tray.

Figure 1B:
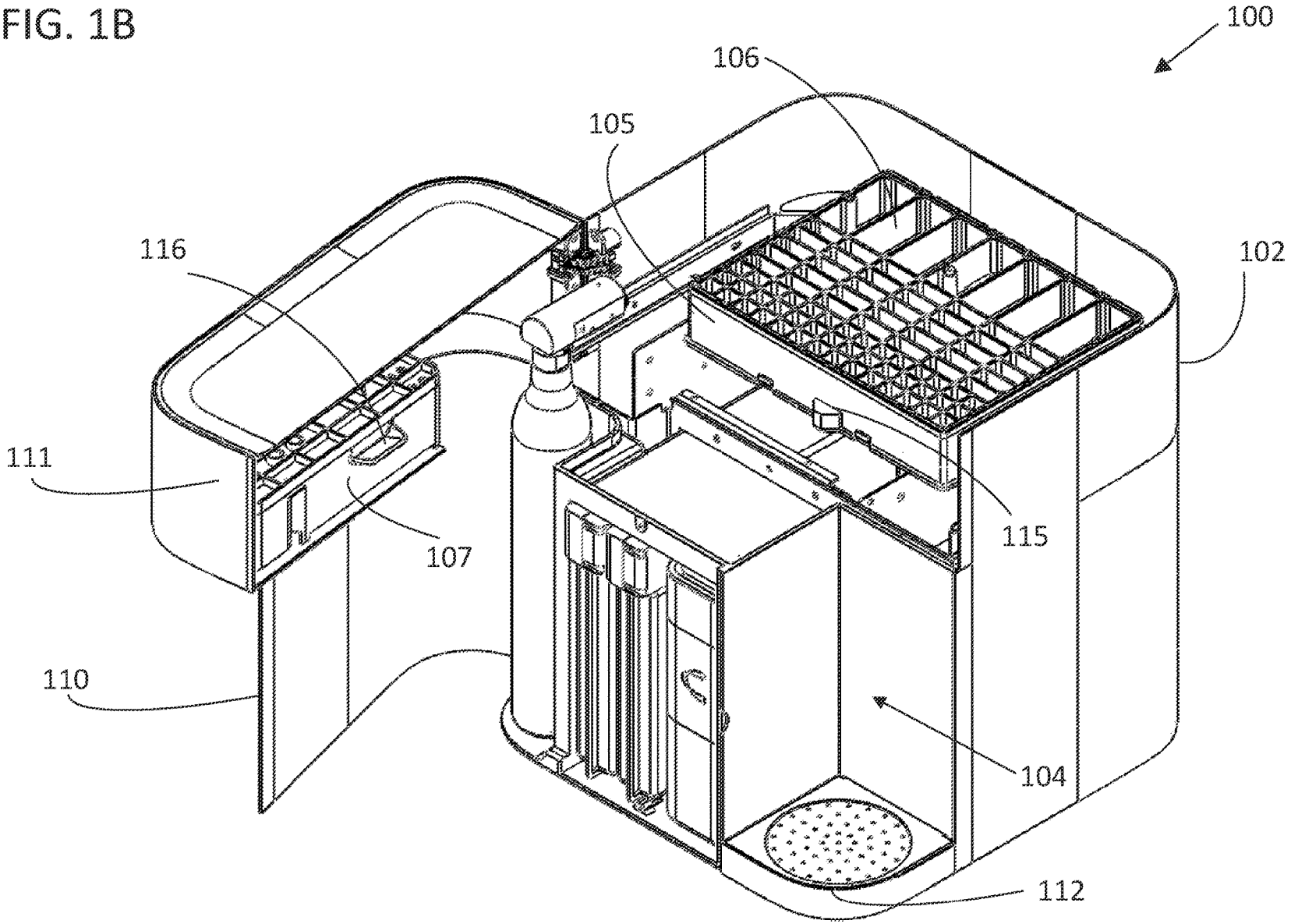
FIG. 1B illustrates exemplary internal components of a fluid mixture dispensing device, in accordance with specific embodiments disclosed herein.

FIG. 1B illustrates the fluid mixture dispensing device 100 of FIG. 1A in an open configuration to illustrate exemplary internal components that can be housed by the casing 102 of the fluid mixture dispensing device 100, in accordance with specific embodiments disclosed herein. The accesses, such as upper access door 111 and the lower access door 110, are open in this figure. The doors can be attached to the remaining of the casing via hinges or other structure. The doors can alternatively be removable doors so that they are completely removed when open. The doors can be any kind of doors such as sliding doors, and open in any direction, for example to the top or to the right of the device. Doors 111 and 110 can be separate doors or a unitary door of the device. In this example, the access doors have been represented in the front wall of the device. However, this is not a limitation of the invention. Different doors and/or any access to the interior of the device can be located anywhere on the device, and do not need to be located on the front wall. In the example of FIG. 1B, a portion of the top wall of the device 100 has been removed to expose some additional exemplary components of the device.

The fluid mixture dispensing device 100 can include one or more ingredient reservoirs, such as ingredient reservoir 106. The ingredient reservoirs can store ingredients to be used by the fluid mixture dispensing device 100 to create a fluid mixture, such as concentrated liquids (e.g., flavor syrups, salts, acids, etc.). The ingredient reservoirs can exhibit the characteristics of any of the ingredient reservoirs described in U.S. Provisional Patent Application No. 63/146,461 filed Feb. 5, 2021 and U.S. patent application Ser. No. 17/547,081 filed Dec. 9, 2021 and U.S. patent application Ser. No. 17/545,699 filed Dec. 8, 2021, all of which are incorporated by reference herein in their entirety for all purposes.

The ingredient reservoirs, such as ingredient reservoir 106, can be located in a cartridge, such as cartridge 105. The cartridge can be accessed via one of the accesses of the device. For example, the cartridge can be accessed through upper access door 111 or by removing the top wall of the device. In this way, a user of the device can replace the cartridge as needed. In the example of FIG. 1B, the top surface of cartridge 105 has been removed to expose the ingredient reservoirs 106. However, the cartridge can be completely encased. In specific embodiments of the invention, the cartridge includes a removable lid so that the various ingredient reservoirs can be accessed, for example to be refilled. The cartridge can exhibit the characteristics of any of the cartridges described in U.S. Provisional Patent Application No. 63/146,461 filed Feb. 5, 2021, U.S. patent application Ser. No. 17/547,081 filed Dec. 9, 2021, U.S. patent application Ser. No. 17/545,699 filed Dec. 8, 2021 and U.S. patent application Ser. No. 17/547,612 filed Dec. 10, 2021, all of which are incorporated by reference herein in their entirety for all purposes.

A cartridge, such as cartridge 105 illustrated in FIG. 1B, can be configured to interact with the device in various ways. In specific embodiments of the invention, the cartridge is configured to dispense ingredients (e.g., from the one or more ingredient reservoirs 106) from a bottom side of the cartridge. The device can include an interface for the cartridge. In specific embodiments of the invention, the interface can be in the form of a surface or plate in which the cartridge can be placed so that the cartridge is in contact with a surface of the interface. The interface can be referred to herein as an interface surface.

Figure 2:
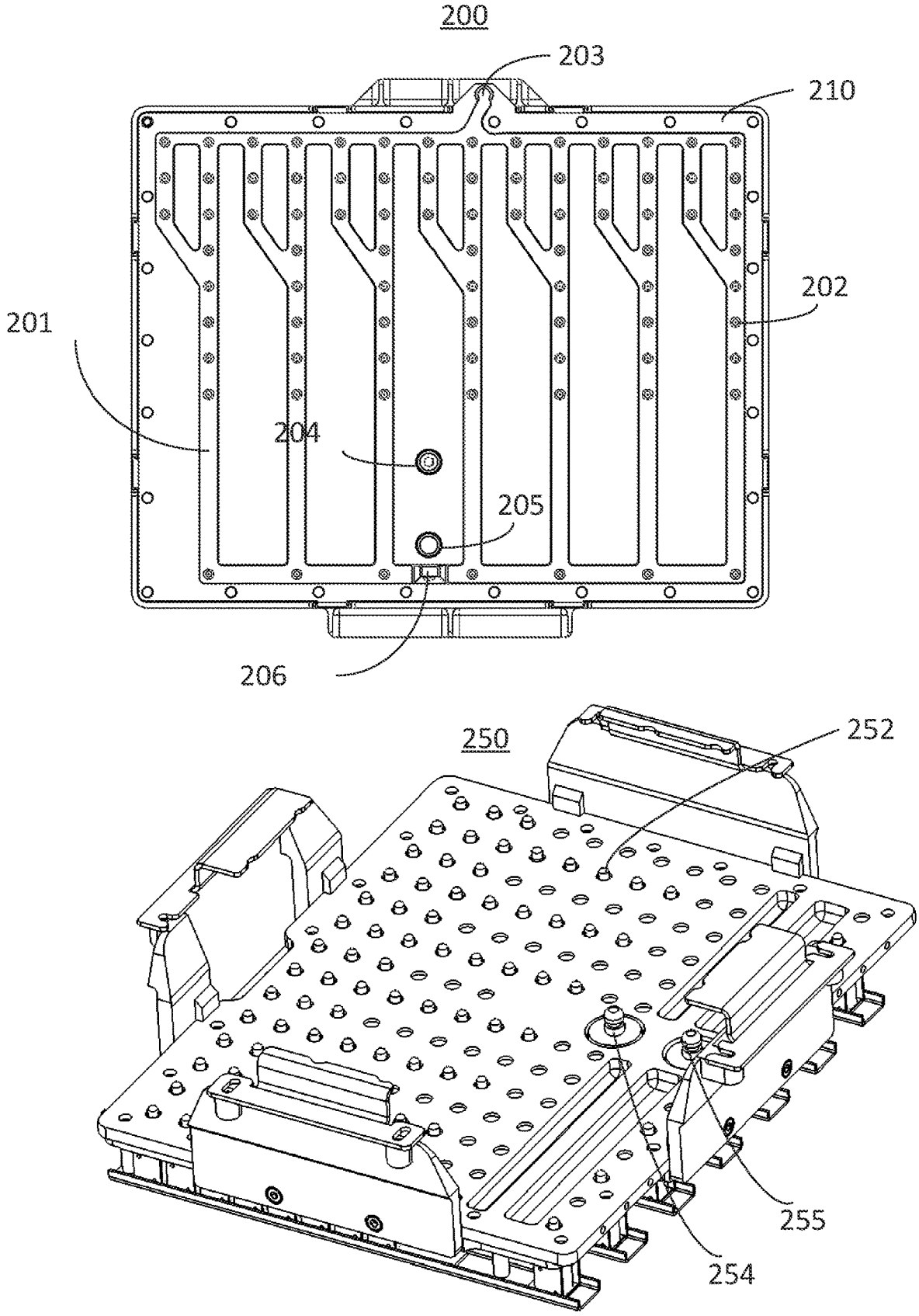
FIG. 2 illustrates an example of a bottom view of an ingredient cartridge and corresponding interface plate, in accordance with specific embodiments disclosed herein.

FIG. 2 illustrates an example of a bottom view 200 of an ingredient cartridge (e.g., cartridge 105) and corresponding interface surface 250. As illustrated, the cartridge can include a plurality of orifices, such as orifice 202, which can correspond to each ingredient reservoir (e.g., 106) so that the ingredients stored in such reservoirs can be dispensed out of the reservoirs through the orifices. The interface surface 250, on the other hand, can include or otherwise work in association with one or more actuators, such as actuator 252. The actuators (e.g., 252) can be upward actuators that exert an upward force towards the cartridge, so that the actuators (e.g., a sealing head of the actuators) seal the orifices of the cartridge (e.g., orifice 202) when the cartridge is placed on the interface surface and the actuators are in a "closed" position. When an ingredient is needed for preparation of a given fluid mixture, the system can be programmed to actuate (e.g., change the actuator from a "closed" position to an "open" position) the corresponding actuator sealing the orifice of the ingredient reservoir where the needed ingredient is stored. The upward actuators can be configured so that, when actuated, they no longer exert an upward force against the cartridge, so the respective orifice can be unsealed, and the ingredient can flow. The upward actuators can be electromechanical actuators (e.g., plungers connected to a solenoid valve) so that their configuration (e.g., open/closed state) can be controlled by a controller of the system executing instructions (for example instructions to prepare a fluid mixture). The upward actuators can be valves (or an actuating part of a valve), or any other structure able to seal the orifices of the cartridge in the manner described herein. In this way, respective valves, when closed, can provide respective seals over the respective orifices of the ingredient reservoirs, and when opened, can enable the flow of the respective ingredients from the ingredient reservoirs, if the cartridge is properly placed on the interface surface.

Bottom view 200 illustrates some additional features that can be included in the cartridge in accordance with specific embodiments of the invention. For example, the cartridge can include a fluid inlet 205 through which fluid (e.g., solvent) can enter the mixing channels of the cartridge (e.g., 201). The interface surface 250 can include a corresponding fluid inlet interface 255 configured to be fluidly connected with the fluid inlet 205 when the cartridge is installed so that fluid (e.g., solvent) can be provided from the device to the cartridge. The cartridge can also include a connection point 206 enabling fluid from the fluid inlet 205 to enter the one or more channels. A structure in the interior of the ingredient cartridge fluidly connects the fluid inlet to the connection point and thus to the one or more channels and to the fluid outlet. In this way, fluid (e.g., a solvent) can be propelled (e.g., pumped) through the fluid inlet and then through the connection point to enter the one or more channels (where one or more ingredients from the ingredient reservoirs can be dispensed, if the respective valve is open) and flow through the one or more channels to a fluid outlet.

The cartridge can also include a gas inlet 204. The gas inlet can provide a flow of gas under pressure to pressurize a pressurized chamber of the ingredient cartridge. The pressure in the pressurized chamber can be used, for example, to force the dispense of the ingredients out of the ingredient reservoirs when the respective valve is open. The interface surface 250 can include a corresponding gas inlet interface 254 configured to be connected with the gas inlet 204 when the cartridge is installed so that gas can be provided from the device to the cartridge.

The cartridge can also include a fluid outlet 203 through which fluid (e.g., an intermediate mixture of one or more ingredients from the ingredient reservoirs and/or one or more solvent(s) in the channels) can flow out of the mixing channels (e.g., 201) to the device. With reference back to FIG. 1B, an outlet 115 of the cartridge 105 can be, or be connected to, the cartridge outlet 203. The outlet 115 can be configured to form a fluid path from the cartridge to an output of the device (e.g., a dispenser in dispense area 104). The fluid path can be formed via a corresponding final dispense inlet 116 configured to be fluidly connected to the outlet 115 of the cartridge when the access 111 is closed. In this way, the intermediate mixture can be dispensed out of the mixing channels in the cartridge to the final dispense chamber 107 and out of the device.

In specific embodiments of the invention, each respective valve (e.g., 252) can be configured to enable and/or control a flow of a respective ingredient from an ingredient reservoir, via a respective orifice of the ingredient reservoir (e.g., 202), to a mixing channel (e.g., 201), or any other part of the device (e.g., to a mixing chamber of the device). Solvent can enter the mixing channels via the fluid inlet (e.g., 205) to form an intermediate mixture with the ingredient(s) dispensed out of the ingredient reservoirs. Such intermediate mixture can then flow out of the mixing channels and into a subsequent compartment in the device, such as a mixing chamber, or final dispense chamber 107, if the cover is closed so that a fluid path is formed.

In some embodiments, one or more mixing channels (e.g., 201) are formed into the bottom of a plate, such as plate 210. The holes in the plate illustrate positions of ingredient reservoirs on the other side of the plate, as the holes are places where respective orifices of the ingredient reservoirs come through the plate. As illustrated in FIG. 2, 202 could represent one of the holes with the respective orifice of the ingredient reservoir in the center. In some embodiments, such as where the ingredient reservoirs are fixedly attached to the plate, the holes are the respective orifices.

In specific embodiments of the invention, the bottom of the cartridge comprises a membrane that can be configured to form the respective seal when pressed against the respective orifice by the actuators, and that enables the respective ingredient to be dispensed when not pressed against the respective orifice. The membrane can be provided with the cartridge itself. For example, the membrane can be attached to the cartridge via negative pressure built inside the cartridge, so that the negative pressure maintains the membrane pressed against the cartridge via the orifices (e.g. 202). In this way, the orifices can be sealed by the membrane via negative pressure when the cartridge is not used (e.g., for shipping and installation). In specific embodiments of the invention, the negative pressure originally provided in the cartridge is altered when the cartridge is installed and gas is provided to the cartridge (e.g., to pressurize the cartridge via gas inlet 204). When the cartridge is installed and connected to the gas inlet, the pressure in the cartridge increases and releases the membrane from the orifices. At this time, if the cartridge is properly installed, the orifices can be sealed by the upward actuators pressing the membrane towards the orifices.

In specific embodiments of the invention, various design parameters can be adjusted to guarantee a good seal of the orifices in the cartridge once the cartridge is installed. For example, the actuator which forces the membrane against the orifice can be larger than the orifices to alleviate alignment requirements for the orifices of the cartridge and the device on which the cartridge is placed while at the same time assuring that the membrane is forced against the entire area of interest. In various embodiments, an area of the actuator (and/or of the compliant material at the head of the actuator) is much larger than an area of the respective orifice, allowing the actuator to not be centered on the respective orifice and still be able to effect sealing of the respective orifice. However, even when an ingredient reservoir is in the closed position (i.e., the respective orifice is sealed by the actuator forcing the membrane against the respective orifice), any fluid/solvent, such as water and/or alcohol, as well as any ingredients dispensed from other ingredient reservoirs, should be able to flow through the mixing channel and around the closed ingredient reservoir. For example, in various embodiments, the actuator and the membrane, when sealing the respective orifice, should not obstruct an entire width of the mixing channel. There are, therefore, various concerns to address regarding the proper installation of the cartridge, to guarantee, for example, a proper alignment of the orifices and respective seals.

Fluid mixture dispensing devices, such as the fluid mixture dispensing device described above with reference to FIGS. 1-2, require a precise installation of the cartridge on the device and can be designed to include a cartridge loader for this purpose. Specific embodiments of the invention disclosed herein include cartridge loaders that assure appropriate installation of the cartridge with the device which can include both appropriate positioning and the appropriate application of pressure to the cartridge.

In specific embodiment of the invention, providing a cartridge loader is advantageous in that the cartridge can be properly placed inside the device by a final user of the device who is not familiar with the structural and functional features of the device described above. In specific embodiments of the invention, it is important that the orifices corresponding to the ingredient reservoirs in the cartridge match the corresponding actuators in the interface plate, and/or that the various interfaces of the cartridge (e.g., gas inlet, fluid inlet, fluid outlet, etc.) are properly connected to the corresponding interfaces in the device. In specific embodiments of the invention, it is also important that appropriate pressure is applied to the cartridge so that, in combination with the upward pressure exerted by the upward actuators, the orifices are properly sealed and unsealed. These and other benefits can be achieved by using specific embodiments of the cartridge loaders described below in this disclosure. An example of the operation of a cartridge loader in accordance with specific embodiments of the invention will be illustrated with reference to FIG. 3A, FIG. 3B and FIG. 3C.

Figure 3A:
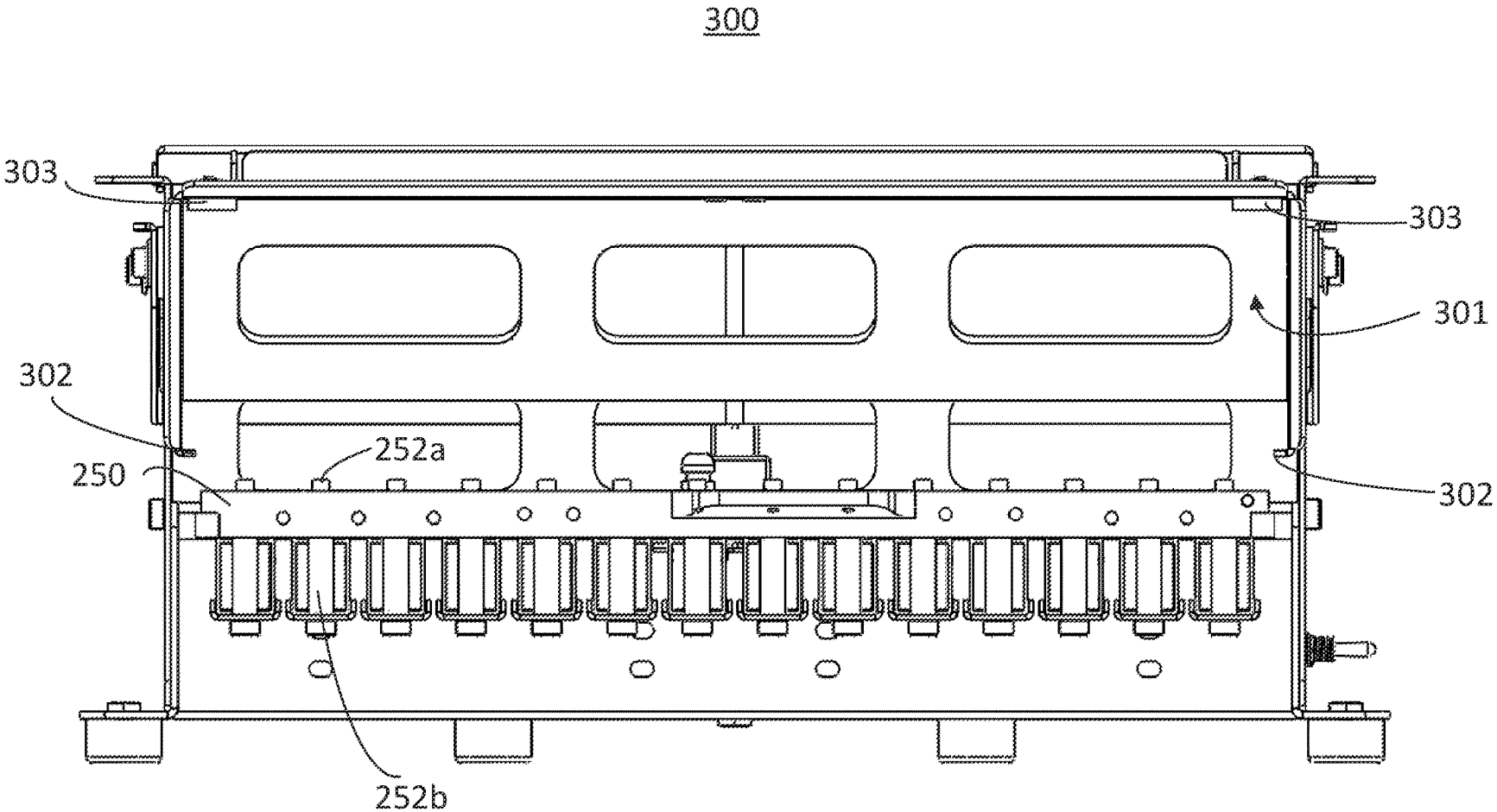
FIG. 3A illustrates an example of a cartridge loader, in accordance with specific embodiments disclosed herein.

FIG. 3A illustrates an example of a cartridge loader 300 in accordance with specific embodiments of the invention. The cartridge loader can be located within the casing of the device, for example within casing 102 of device 100 described with reference to FIG. 1A and FIG. 1B. In the specific example illustrated in FIG. 1B, the cartridge loader could be located in the upper area inside casing 102 that surrounds cartridge 105. However, this is not a limitation of the invention and the cartridge loader could be located anywhere else in the device as long as it serves the function of loading the ingredients cartridge for the subsequent use with the device (e.g., for preparation of fluid mixtures).

In specific embodiments of the invention and with reference back to FIG. 2, the cartridge loader can be located on top of the interface surface 250 so that when the cartridge is loaded, the bottom 200 of the cartridge 105 is in contact with the corresponding structures in the interface plate. For example, the cartridge loader can be placed so that when the cartridge is loaded any connection interfaces in the cartridge match the corresponding connection interfaces in the device (e.g., a gas inlet for providing gas from the device to the cartridge and/or a fluid outlet for the fluid to flow from the cartridge to the rest of the system). As another example, the cartridge loader can be placed so that when the cartridge is loaded the actuators in the interface plate can properly seal the orifices in the bottom of the cartridge.

The cartridge loader can be a structure embedded in the fluid mixture dispensing device or a separate structure that can be detachably attached to the device. For example, at least part of the cartridge loader 300 (e.g., the lateral walls, top, bottom) can be molded with the internal structure of device 100. As another example, the cartridge loader can be a detachable structure and comprise attachment means to be attached to the device. The attachment means can include screws, pins, keying arrangements (e.g., protuberances on the cartridge loader fit recesses on a corresponding area in the device) etc. In specific embodiments, the device 100 can include a slot adapted to receive the cartridge loader, for example the cartridge loader can rest on a surface of the device or be connected to other parts of the device via other means. The cartridge loader can be of the same material as the casing of the device or internal frame of the device, such as metal, plastic, or any other suitable material.

FIG. 3A illustrates the interface surface 250 and a set of upward actuators (such as actuator 252 introduced with reference to FIG. 2). The actuators can operate through the interface surface and include an actuator part 252*b* that moves the sealing heads 252*a* (for example 252*b* can be a solenoid body and 252*a* can be the plungers of the solenoid). The interface surface can include orifices through which the sealing heads of the actuators can move to alternatively seal/unseal the orifices of the ingredient reservoirs in the cartridge. The interface surface can be of the same material as the cartridge loader, such as metal, plastic, or of any other suitable material.

FIG. 3A illustrates an empty cartridge loader (i.e., without a cartridge installed). In specific embodiments of the invention, the cartridge loader includes or is in the form of a cartridge receiver carriage. The cartridge receiver carriage can be the part of the cartridge loader that is configured to receive and "carry" the cartridge when the cartridge is being installed and hold the cartridge once it is installed, for example the area pointed by arrow 301 in FIG. 3A.

The cartridge receiver carriage can include one or more alignment features to aid in the correct placement of the cartridge within the carriage. Those alignment features will be referred to as "insertion alignment features" as they can be used to align the cartridge when the cartridge is being "inserted" into the carriage. The insertion alignment features can include grooves and/or protuberances that match corresponding protuberances and/or grooves on the cartridge. The insertion alignment features can include guides through which the cartridge can slide into the carriage. The insertion alignment features can be the walls of the cartridge receiver carriage itself. For example, the cartridge receiver carriage can include or be in the form of a slot into which the cartridge can be placed. The dimensions of the slot can be slightly bigger that the dimensions of the cartridge so that the cartridge can be placed into the slot, but still providing a tight fit for the cartridge so that there is only one position for the cartridge to be placed in the slot and for the cartridge to be roughly aligned with its desired device position in the device. In this way, the structure defining the slot can delimit the positioning of the cartridge in the carriage and therefore serve to guide the cartridge into the proper position.

FIG. 3A illustrates insertion alignment features in the form of sliding rails 302. In this example, the cartridge 105 may or may not include corresponding insertion alignment features. For example, the cartridge can include grooves to receive the rails and guide the cartridge insertion operation. As another example, the cartridge could not include any corresponding insertion alignment feature and the alignment can be conducted by simply sliding the cartridge itself (e.g., side-bottom edges of the cartridge) through the rails, so that cartridge rests on the rails when loaded. The illustrated sliding rails 302 can be at one or each side of the cartridge, including the top edges of the cartridge. The insertion alignment means can also be in the form of a cut out plate or frame that allows the cartridge to be inserted while not obstructing the bottom of the cartridge so that the interaction with the interface surface 250 is not compromised.

FIG. 3A also illustrates insertion alignment features in the form of upper guides 303, which can, in combination with the sliding rails 302, delimit a slot for placement of the cartridge and therefore guide the movement of the cartridge into the slot. Upper guides 303 can also serve as stoppers so that the top of the cartridge is not in contact with other parts of the device. For example, upper guides 303 can be padded guides that protect the cartridge and internal walls of the device from being scratched and/or damaged while the cartridge is being placed inside the device. Upper guides 303 can also serve as points of contact with the cartridge so that when the loader is in operation (for example to depress the cartridge, as will be explained below in more detail) any pressure applied to the cartridge is transmitted via the upper guides 303, which can be of an appropriate material for this function, and can be placed in a strategic position (for example to exert pressure on a point of the cartridge that is not susceptible to pressure application, such as a metallic skeleton instead of a plastic casing).

Figure 3B:
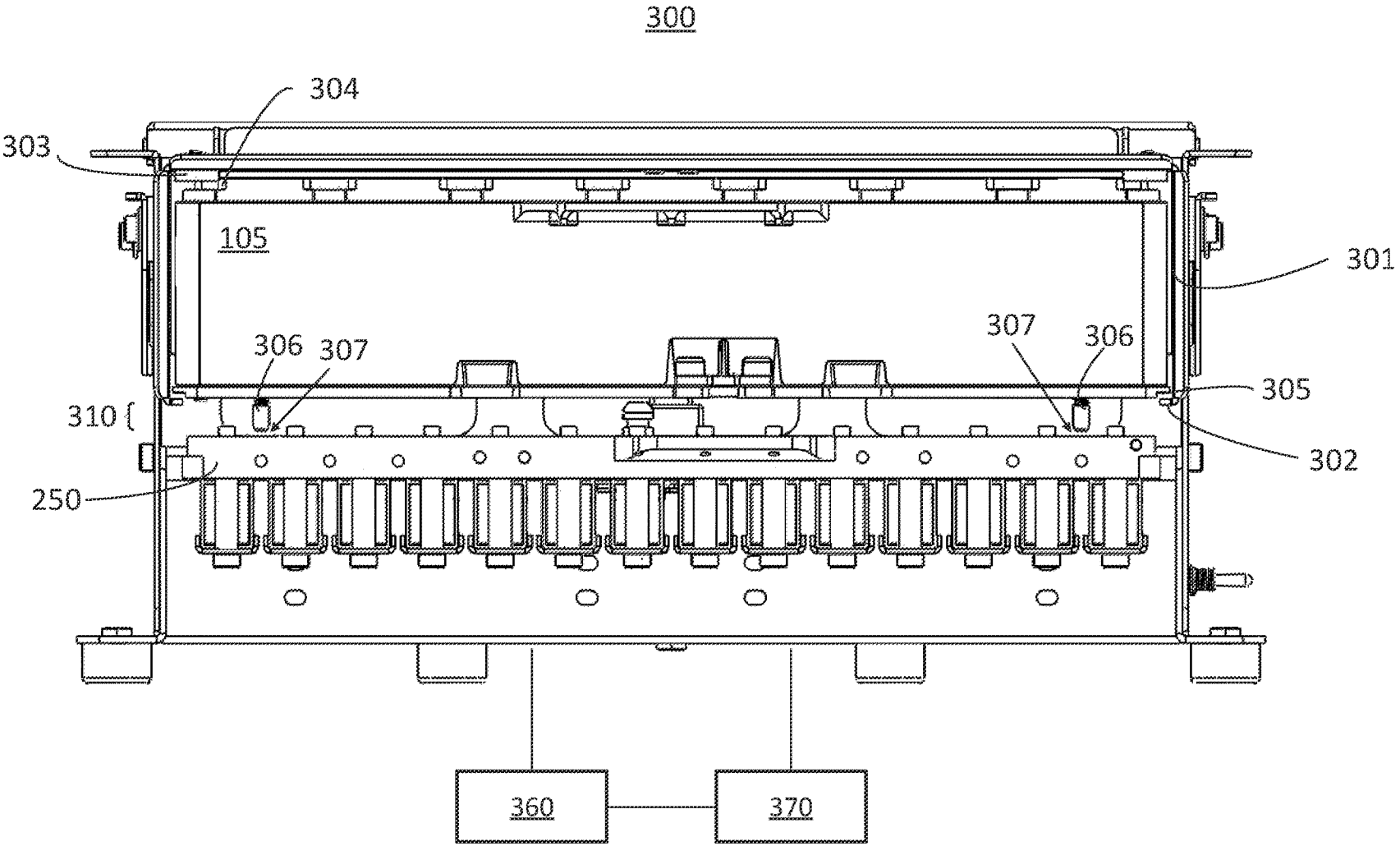
FIG. 3B illustrates an example of a cartridge inserted in a cartridge receiver carriage of a cartridge loader, in accordance with specific embodiments disclosed herein.

FIG. 3B illustrates an example of a cartridge, such as cartridge 105, inserted in a cartridge receiver carriage (e.g., 301) of a cartridge loader such as cartridge loader 300. In specific embodiments of the invention, the cartridge can be shaped so that it matches the cartridge receiver carriage and/or specific features therein. For example, the cartridge can include insertion alignment features such as recesses/protuberances that match protuberances/recesses in the carriage. In the illustrated example of FIG. 3B, the cartridge includes recesses 304 and 305 shaped to match the corresponding upper guides 303 and sliding rails 302. In such embodiments, the cartridge can be placed inside the carriage with an even more precise fit as the matching guides/recesses will limit the position of the cartridge inside the carriage. However, this is not a limitation of the present invention as the cartridge can be a smooth cube, or other shape, with no added features for this purpose.

In specific embodiment of the invention, when the cartridge is inserted in the cartridge receiver carriage, the bottom of the cartridge may not be in contact with the interface surface, or at least not tightly enough so as to allow the upward actuators to seal the orifices in the cartridge. As illustrated in the example of FIG. 3B, there can be a gap 310 between the cartridge and the interface surface when the cartridge is inserted in the carriage. In specific embodiments, this gap may be necessary to allow space for the cartridge to slide in without interfering with the various features of the interface surface (e.g., the upward actuators, the gas and fluid interfaces, etc.). The gap 310 allows the cartridge to be inserted and corresponding features in the bottom of the cartridge to be aligned with the respective features in the interface surface before the cartridge is adjusted for further use. In specific embodiment of the invention, it may not be possible to install the cartridge without providing such gap as the various features of the interface surface (e.g., actuators and interfaces) could prevent the cartridge from entering the carriage if the cartridge were to enter flush with the interface surface.

Figure 3C:
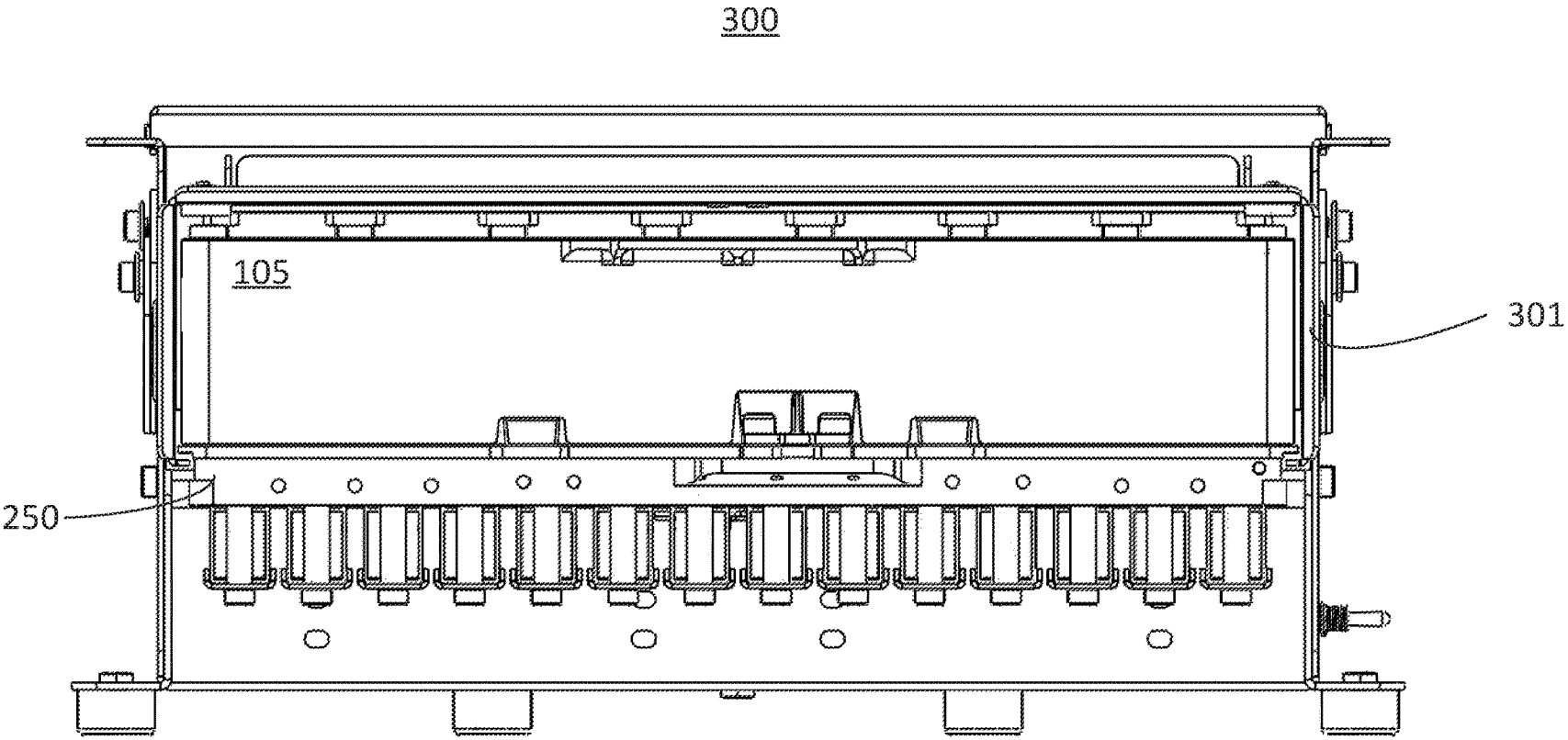
FIG. 3C illustrates an example of a cartridge depressed against an interface surface, in accordance with specific embodiments disclosed herein.

In specific embodiments of the invention, the cartridge loader 300 can be configured to depress the cartridge receiver carriage towards the interface surface 250 to load a cartridge 105 so that it is in contact with the interface surface 250. For example, and as will be described below in more detail, the cartridge loader can include one or more actuators configured to depress the cartridge receiver carriage towards the interface surface to load a cartridge. In specific embodiments of the invention, the actuator can be configured to automatically depress the cartridge receiver carriage towards the interface surface to load the cartridge when the cartridge is placed in the cartridge receiver carriage. In other specific embodiments of the invention, the actuator can be configured to depress the cartridge receiver carriage towards the interface surface to load the cartridge in response to an external force, for example a force applied manually to the cartridge receiver carriage. FIG. 3C illustrates an example of the cartridge 105 depressed against and therefore in contact with the interface surface.

In specific embodiments of the invention, the cartridge loader includes alignment features configured to aid in the proper placement of the cartridge as it is pressed down towards the interface surface. Those alignment features will be referred to as "depression alignment features" as they are used to align the cartridge when the cartridge is being "depressed" towards the interface plate. The depression alignment features can include the same alignment features described before with reference to the insertion alignment features. The depression alignment features can be used alone or in combination with the insertion alignment features described above for the placement of the cartridge inside the carriage.

With reference back to FIG. 3B, a specific example of depression alignment features configured to aid in the proper placement of the cartridge when the cartridge is pressed down comprises protuberances (such as pegs 306 in cartridge 105) configured to fit corresponding recesses (such as holes 307 in interface surface 250) to guarantee that the cartridge is pressed down in the proper position. One or more depression alignment features can be used. In specific embodiments of the invention, two sets of alignment features are provided so that both sides of the cartridge are properly aligned (e.g., one peg and one matching hole at each side of the cartridge and interface surface). In other specific embodiments of the invention, none, one, three or more sets of depression alignment features can be provided.

One or more alignment features as described above can be used alone or in combination. For example, insertion alignment features to guide the cartridge as it is placed in the cartridge carriage (such as rails 302 in FIG. 3B) can be used alone or in combination with depression alignment features to guide the cartridge carriage as it is pressed down towards the interface plate (such as pegs 306 and holes 307) and vice versa.

In specific embodiments of the invention, when more than one alignment feature is used, the various alignment features can have various degrees of precision. For example, the insertion alignment features configured to guide the cartridge as it is placed inside the carriage can have a degree of precision which is less than a degree of precision provided by the depression alignment features configured to guide the cartridge as it is pressed down. In this way, one set of alignment features can be used to place the cartridge in a first position and the other to place the cartridge in a second, more accurate (e.g., exact), position. The cartridge can be guided by the insertion alignment features (e.g., by the sliding rails 302 and/or upper guides 303) to a position where the cartridge, if pressed down, would have all or most of its features aligned with the corresponding features in the interface surface. However, in specific embodiments of the invention, providing additional depression alignment means (such as pegs 306) further perfects the alignment of the cartridge in that sub-millimetric precision can be achieved. In specific embodiments, the degree of alignment between the cartridge and interface surface is +/−0.01 mm.

The alignment features can be part of or distributed among the cartridge itself, the cartridge carriage, the interface plate, and/or any part of the cartridge loader. In the illustrated example, the insertion alignment features (e.g., sliding rails 302) are in the cartridge receiver carriage and, as explained, are adapted to horizontally align the cartridge, with a first degree of precision, along the cartridge receiver carriage as the cartridge is inserted into the cartridge receiver carriage. The depression alignment features, on the other hand, are distributed among the cartridge (e.g., pegs 306) and the interface plate (e.g., matching holes 307) and, as explained, are adapted to horizontally align the cartridge, with a second degree of precision, as the cartridge is pressed towards the interface surface when the cartridge is loaded. In this example, and as also explained before in this disclosure, the degree of precision of both sets of alignment features can be different. For example, the degree of precision of the insertion alignment features can be less than the degree of precision of the depression alignment features so that the insertion alignment features provide a rough alignment for the cartridge to be depressed while the depression alignment features provide a more precise alignment for the cartridge to interact with the interface plate. In the illustrated example, the rails 302 are provided with the carriage, and the pegs 306 are provided with the cartridge 105 itself (e.g., the pegs can be molded and/or attached to the cartridge by a manufacturer so that the cartridge is already provided with the alignment features when received by a user for installation). However, this is not a limitation of the present invention as the rails, protuberances or other alignment features can be in the carriage or anywhere else as long as they provide guidance for the cartridge as it is inserted and/or pressed down.

In specific embodiments of the invention, the actuator can be configured to depress the cartridge receiver carriage towards the interface surface to load the cartridge in a substantially vertical direction. The depression alignment features (e.g., protrusions on the cartridge and/or matching holes in the interface plate) described before in this disclosure can be distributed so that they are adapted to horizontally align the cartridge as the cartridge is pressed towards the interface surface when the cartridge is loaded (e.g., in the substantially vertical direction mentioned before with reference to specific embodiments of the invention).

In specific embodiments of the invention, the device is configured to press the cartridge down only when the cartridge is in an appropriate position inside the carriage. For example, the cartridge loader can include means for detecting if the cartridge has been completely and correctly inserted into the carriage (e.g., position illustrated in FIG. 3B) before pressing the cartridge down (e.g., to the position illustrated in FIG. 3C). The means for detecting can be mechanical means such as mechanical arrangements (e.g., locks) whose mechanical configuration (e.g., position) changes by the proper placement of the cartridge inside the carriage. For example, a mechanical arrangement could be configured to block the cartridge from moving downwards until the cartridge is fully placed inside the carriage, and the cartridge itself can "unlock" the mechanical arrangement when properly inserted, by moving the mechanical arrangement to a position that allows downward movement once the cartridge has reached the proper position within the carriage. The means for detecting can also be electronic means such as sensors (e.g., presence sensors, light sensors, cameras, and the like) configured to sense the presence of, or position of, the cartridge and allow and/or action the downward movement in response to the detection of the proper placement of the cartridge inside the carriage. In any case, the system can be configured to detect an appropriate placement of the cartridge inside the cartridge receiver carriage and to allow the downward movement of the cartridge towards the interface plate (e.g., allow an actuator to depress the cartridge towards the interface surface when the cartridge is in the appropriate placement).

In specific embodiments of the invention, the system is configured to apply continuous downward pressure on the cartridge towards the interface surface when the cartridge is loaded. The continuously downward pressure can be applied to ensure that the cartridge remains pressed against the interface surface and that any fluid interfaces between the cartridge and interface surface remain tightly, or hermetically, sealed. As described before in this disclosure with reference to FIG. 2, the interface surface can include a set of upward actuators, configured to apply an upward force towards the cartridge when the cartridge is loaded, and configured to seal the orifices on the cartridge when the cartridge is loaded. In specific embodiments of the invention, the continuous downward pressure applied on the cartridge towards the interface surface when the cartridge is loaded can depend on the number of upward actuators in the set of upward actuators and/or the upward force applied by the upward actuators towards the cartridge. This can be beneficial in that the downward pressure applied to the cartridge can offset the upward force exerted by the upward actuators, and therefore the cartridge will be properly pressed against the interface plate with the orifices sealed by the respective upward actuators. If the cartridge is not properly and continuously pressed down, this can result in one or more of the cartridge orifices being unsealed which could lead to an undesirable leak of ingredients out of the cartridge.

In specific embodiments of the invention, the continuous downward pressure exceeds the weight of the cartridge when filled so that the continuous downward pressure will constantly push the cartridge down. In specific embodiments of the invention, the cartridge weighs between 5 and 10 pounds when full, and more specifically around 3.4 kg (7.5 lbs) when full. In specific embodiments of the invention, the cartridge weights between 2 and 3 pounds when empty, and more specifically around 1.1 kg (2.5 lbs) when empty. In specific embodiments of the invention, the pressure applied to the cartridge can be equivalent to a weight in a range of 9-13 kilograms, and more specifically around 11.1 kg (24.5 lbs). This pressure can be applied via a single actuator, as will be described with reference to FIG. 5.

In specific embodiments of the invention, the system can include at least one sensor (e.g., sensor 360) configured to sense the continuous downward pressure applied on the cartridge. The sensor can be located anywhere in the system so long as it can measure the pressure. For example, the sensor can be associated to or otherwise configured to measure the pressure that an actuator is applying to the cartridge carriage to press it down. The sensor can be located in the interface surface and configured to measure a pressure exerted on such plate. The sensor can be a weight sensor configured to sense the weight of the cartridge as pressed against the interface surface and determine the pressure therefrom.

In specific embodiments of the invention, the fluid mixture dispensing system is configured to update the continuous downward pressure applied on the cartridge based on a measurement of at least one sensor. For example, a controller (e.g., controller 370) of the system can be configured to receive signals relative to the measurements of the one or more sensors (e.g., 360) and adjust the pressure in response. If it is determined, from the measurements, that the pressure is not high enough, the controller can control the actuators or other elements of the system so that more pressure is applied to the cartridge. Similarly, the pressure applied to the cartridge can depend on the weight of the cartridge and be adjusted as the weight changes (for example as the ingredients in the cartridge are used).

Figure 4:
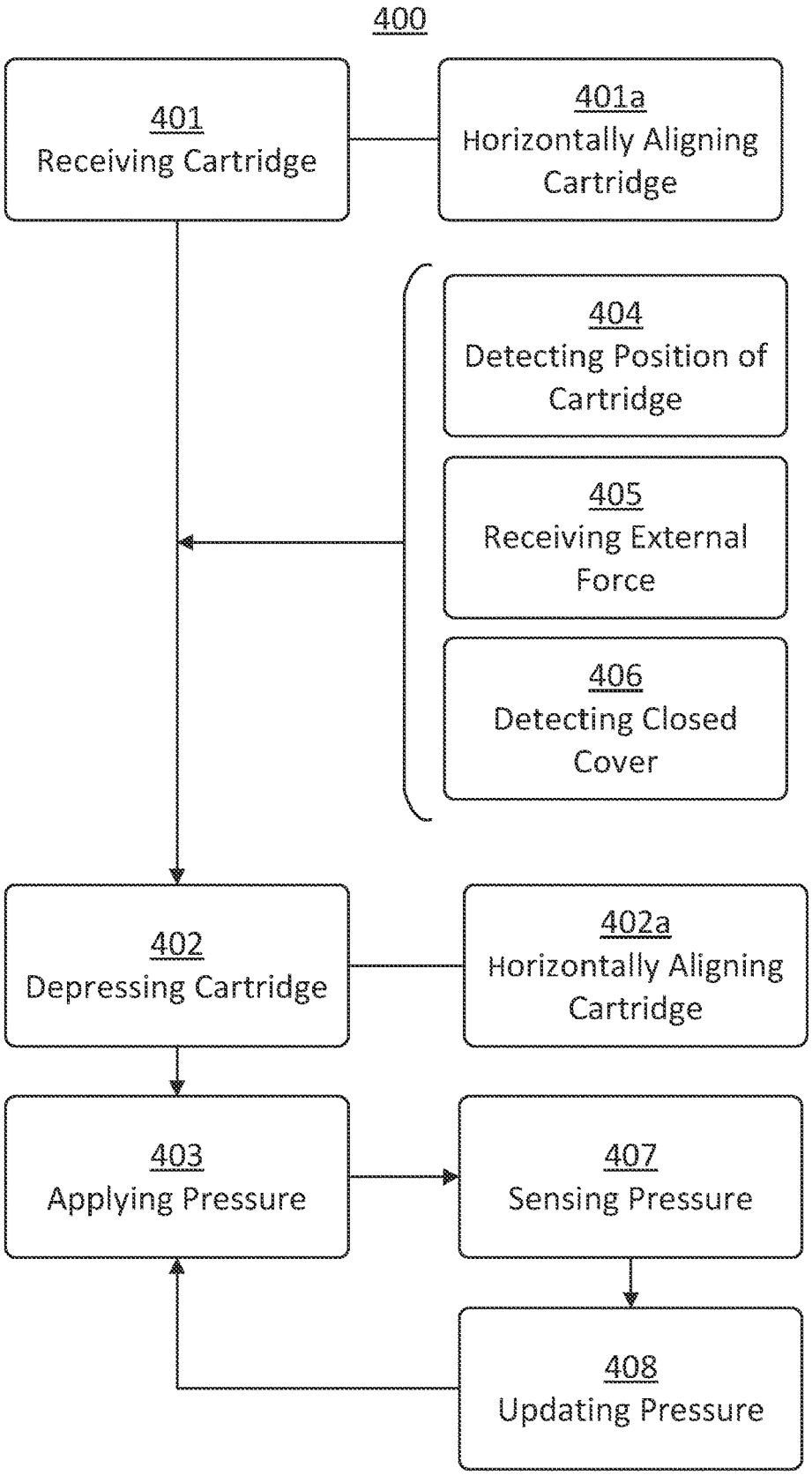
FIG. 4 illustrates a flowchart for a set of methods of loading a cartridge in a fluid mixture dispensing device, in accordance with specific embodiments disclosed herein.

FIG. 4 illustrates a flowchart for a set of methods of loading a cartridge (such as cartridge 105) in a fluid mixture dispensing device (such as system/device 100). Flowchart 400 starts with a step 401 of receiving the cartridge. The cartridge can be received in a cartridge receiver carriage of the fluid mixture dispensing device as illustrated with reference to FIGS. 3A and 3B. As explained before in this disclosure, this step can include horizontally aligning the cartridge along the cartridge receiver carriage (e.g., using insertion alignment features), as indicated by substep 401*a*. In alternative embodiments, the cartridge can be received by being dropped into a carriage from a top-down direction. Such approaches may involve lifting a cover away from the cartridge receiver to expose the cartridge receiver carriage. Such approaches may also include horizontally aligning the cartridge in the cartridge receiver carriage. Flowchart 400 continues with a step 402 of depressing the cartridge receiver carriage. The cartridge receiver carriage can be depressed towards an interface surface of the fluid mixture dispensing device to load the cartridge, as explained with reference to FIGS. 3B and 3C. As also explained before in this disclosure, this step can include horizontally aligning the cartridge as the cartridge is pressed down (e.g., using depression alignment features), as indicated by substep 402*a*.

In specific embodiments of the invention, step 402 of depressing the cartridge happens automatically after step 401 of receiving the cartridge. In other specific embodiments of the invention, the method can include a step 404 of detecting an appropriate position of the cartridge before pressing the cartridge down (for example detecting that the cartridge is properly placed in the carriage) before the depressing step 402 is executed. In specific embodiments of the invention, the depressing step 402 can be performed automatically after the detecting in step 404. For example, a sensor in the carriage can detect that the cartridge has been duly inserted and trigger the actuator to press the cartridge down. As an alternative, step 402 can be carried out by manually actioning the actuator (e.g., via a switch or manually pressing the cartridge down), as indicated by step 405 of receiving an external force applied manually to the cartridge receiver carriage, where the cartridge can be depressed in response to such external force.

In specific embodiments of the invention, the method can include a step 406 of detecting that a cover for an opening of the cartridge has been closed, and automatically triggering the actuator to depress the cartridge towards the interface surface upon detecting that the cover is closed. As an alternative, the method can include detecting that the cover has been closed, and only allowing the cartridge to be depressed if the cover is closed. The cover can be, for example, upper access door 111 described with reference to FIG. 1B. The cover can be, for example, a lift away cover for a top compartment of a fluid mixture dispensing device in situations in which the cartridge is loaded from a top-down direction.

In specific embodiments of the invention and still with reference back to FIG. 1B, the system 100 can include a fluid path from the cartridge 105 to an output of the system (e.g., a dispenser in dispense area 104). The cover can include at least portion of such fluid path. For example, final dispense chamber 107 in door 111 can be configured to dispense a fluid mixture to dispense area 104. The fluid mixture can be, or be obtained from, an intermediate mixture received from the cartridge. The intermediate mixture can be provided from the cartridge 105 to the final dispense chamber 107 via the respective cartridge outlet 115 and final dispense inlet 116, which can be fluidly connected when the access door 11 is closed. In this way, when the cover is closed the path is fluidly connected and the device can dispense fluid mixtures prepared with ingredients stored the cartridge.

In specific embodiments of the invention, after the execution of steps 401 and 402, the cartridge is duly loaded and ready to use. In specific embodiments of the invention, flowchart 400 includes a step 403 of applying continuous downward pressure on the cartridge towards the interface surface when the cartridge is loaded. As explained before in this disclosure, the continuous downward pressure is applied to ensure that the cartridge is constantly pressed against the interface plate, so that the actuators seal the orifices of the cartridge. As also explained before in this disclosure, this pressure can depend on the weight of the cartridge and number of upward actuators in the interface surface, as well as the force that such upward actuators exert towards the cartridge.

Flowchart 400 also includes an optional step 407 of sensing the continuous downward pressure applied on the cartridge. As explained before in this disclosure, one or more sensors can be used to sense the pressure being applied. The measurements of the at least one sensor can be used to update the pressure being applied, as indicated by optional step 408, so that the continuous downward pressure is dynamically adjusted depending on the sensed values. In specific embodiments of the invention, the at least one sensor is used to sense the weight of the cartridge on the interface surface and adjust the pressure based on such measurements, so that the pressure can be adjusted as the weight of the cartridge varies. In specific embodiments of the invention, the pressure can also be adjusted based on the number of actuators currently exerting an upward force towards the cartridge, so that if a number of actuators are open (i.e., not exerting force against the cartridge), the pressure can be adjusted accordingly. The pressure can be adjusted based on any other factor that influences the proper contact of the bottom of the cartridge with the interface surface.

Figure 5:
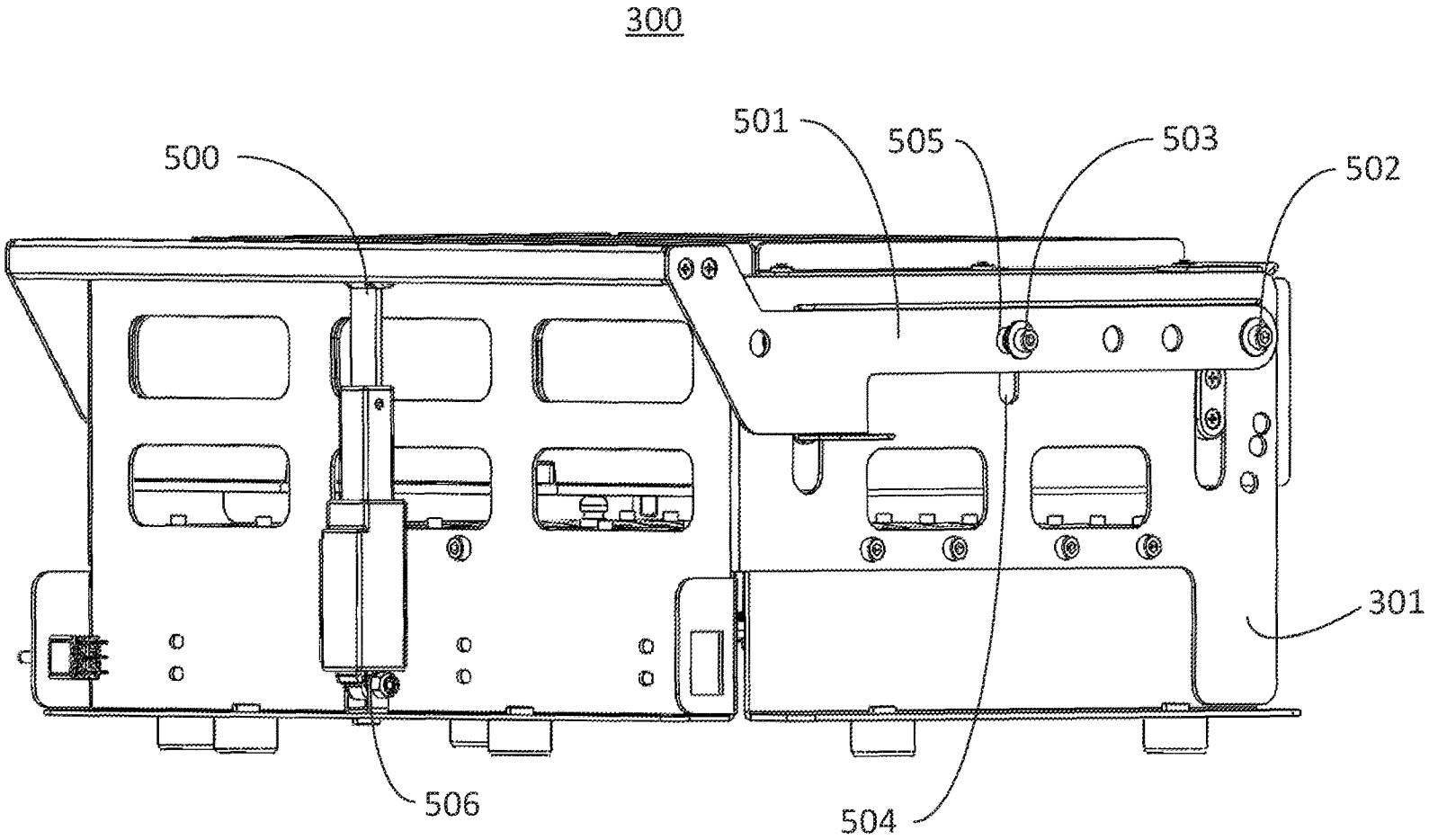
FIG. 5 illustrates a back-right view of a cartridge loader, including an actuator, in accordance with specific embodiments disclosed herein.

FIG. 5 illustrates a back-right view of the cartridge loader 300, including an actuator 500 in accordance with specific embodiments of the invention disclosed herein. Actuator 500 and the illustrated configuration in FIG. 5 allow for a single actuator located towards the back of the device to lower the carriage in a substantially vertical direction. Actuator 500 is connected to the carriage via two linked pivoting arms. One of the pivoting arms is pivoting arm 501 which is shown in FIG. 5 and is representative of the other pivoting arms as the two linked pivoting arms are symmetrical. Pivoting arm 501 pivots around fixed pivot 502 in response to the actuation of actuator 500. In doing so, pivoting arm 501 translated substantially vertical downward force on the carriage through pin 503 (and a corresponding pin on the other side of the device) which extends through notch 504 in the chassis of the device. Pin 503 is configured to move vertically through the expanse of notch 504 and is also able to move horizontally through the expanse of notch 505 in pivoting arm 501 as the pivoting arm 501 moves through its arc. Actuator 500 is likewise mounted on a pivot 506 to allow the point at which actuator 500 connects to the linked pivoting arms to move through a related arc. Using this approach, a single actuator is able to be located on the back of the cartridge loader chassis and still move the cartridge in a substantially vertical direction as it is loaded.

In the illustrated example, the actuator 500 is placed on a back portion of the cartridge receiver carriage 301. However, this is not a limitation of the present invention as the actuator can be placed anywhere in the cartridge loader 300 so long as it can be configured to apply pressure on the carriage to depress the cartridge towards the interface surface. For example, the actuator could include two independent actuators on the sides of the carriage that pull the carriage down in a vertical direction simultaneously. As another example, the actuator could be placed above the carriage and push down on a central portion of the carriage to load the cartridge. As another example, the actuator could be placed below the carriage and pull the carriage down to load the cartridge. As another example, the actuator could be placed on the front and back of the carriage and pull the carriage down in a vertical direction simultaneously. In embodiments in which the cartridge is loaded into the carriage from the front, such an approach may not be feasible. In embodiments in which the cartridge is loaded into the carriage from the top, a top actuator may not be feasible. In specific embodiments of the invention, positioning the actuator on the back of the cartridge loader can be advantageous in that this space can be optimized for this purpose without compromising other structures in the device. Positioning the actuator in other positions such as towards the bottom of the cartridge may not be ideal because it could interfere with the dispense of ingredients and consume space that could otherwise be used for additional upward actuators. Similarly, positioning the actuator to the sides could consume space used for other structural components or unacceptably expand the footprint of the device.

The examples described before in this disclosure are non-limiting embodiments of the invention. Multiple variations can be made to the illustrated examples. For example, the interface surface was presented as a horizontal flat surface in the drawings, but the invention can be applied to any surface, including steep, vertical, and/or irregular surfaces. Similarly, the examples described herein illustrate a cartridge loaded from the front of an upper portion of the device. However, the cartridge slot can be located anywhere in the device, such as to the sides or back, or a lower part of the device. The cartridge loader described herein would equally apply to a cartridge loaded into the bottom of a device, pressed upwards, where the interface plate is on the top of the cartridge instead of a bottom, or to a cartridge loaded vertically, and pressed sidewards, where the interface surface is to the side.

While the specification has been described in detail with respect to specific embodiments of the invention, it will be appreciated that those skilled in the art, upon attaining an understanding of the foregoing, may readily conceive of alterations to, variations of, and equivalents to these embodiments. Any of the method disclosed herein can be executed by a processor in combination with a computer readable media storing instructions for the methods in combination with the other hardware elements described above. These and other modifications and variations to the present invention may be practiced by those skilled in the art, without departing from the scope of the present invention, which is more particularly set forth in the appended claims.

What is claimed is:

1. A fluid mixture dispensing system comprising:

an interface surface;

a cartridge receiver carriage;

an actuator configured to depress the cartridge receiver carriage towards the interface surface to load a cartridge;

a set of protrusions on a bottom side of the cartridge; and a set of recesses on the interface surface;

wherein: (i) the set of protrusions serve as a set of alignment features: (ii) the set of alignment features are adapted to horizontally align the cartridge as the cartridge is pressed towards the interface surface when the cartridge is loaded; and (iii) the fluid mixture dispensing system is configured to apply continuous downward pressure on the cartridge towards the interface surface when the cartridge is loaded and is in contact with the interface surface.

2. The fluid mixture dispensing system of claim 1, wherein:

the cartridge has a weight when filled; and the continuous downward pressure exceeds the weight of the cartridge.

3. The fluid mixture dispensing system of claim 1, further comprising:

at least one sensor configured to sense the continuous downward pressure applied on the cartridge;

wherein the fluid mixture dispensing system is further configured to update the continuous downward pressure applied on the cartridge based on a measurement of the at least one sensor.

4. The fluid mixture dispensing system of claim 1, further comprising:

a set of upward actuators in the interface surface, configured to apply an upward force towards the cartridge when the cartridge is loaded, and configured to seal a set of orifices on the cartridge when the cartridge is loaded;

wherein the continuous downward pressure applied on the cartridge towards the interface surface when the cartridge is loaded depends on at least on one of: (i) a number of upward actuators in the set of upward actuators; and (ii) the upward force applied by the set of upward actuators towards the cartridge.

5. The fluid mixture dispensing system of claim 1, wherein:

the continuous downward pressure applied on the cartridge towards the interface surface when the cartridge is loaded is equivalent to a weight in a range of 9-13 kilograms.

6. The fluid mixture dispensing system of claim 1, wherein:

the actuator is configured to automatically depress the cartridge receiver carriage towards the interface surface to load the cartridge when the cartridge is placed in the cartridge receiver carriage.

7. The fluid mixture dispensing system of claim 1, wherein:

the actuator is configured to depress the cartridge receiver carriage towards the interface surface to load the cartridge in response to an external force applied manually to the cartridge receiver carriage.

8. The fluid mixture dispensing system of claim 1, wherein:

the actuator is configured to depress the cartridge receiver carriage towards the interface surface to load the cartridge in a substantially vertical direction.

9. The fluid mixture dispensing system of claim 1, further comprising:

a first set of alignment features;

wherein the first set of alignment features are in the cartridge receiver carriage; and wherein the first set of alignment features are adapted to horizontally align the cartridge, with a first degree of precision, along the cartridge receiver carriage as the cartridge is inserted into the cartridge receiver carriage.

10. The fluid mixture dispensing system of claim 9, further comprising:

a second set of alignment features, wherein the second set of alignment features comprise the set of protrusions;

wherein the second set of alignment features are adapted to horizontally align the cartridge, with a second degree of precision, as the cartridge is pressed towards the interface surface when the cartridge is loaded; and wherein the first degree of precision is less than the second degree of precision.

11. The fluid mixture dispensing system of claim 1, wherein the fluid mixture dispensing system is further configured to:

detect an appropriate placement of the cartridge inside the cartridge receiver carriage; and allow the actuator to depress the cartridge towards the interface surface when the cartridge is in the appropriate placement.

12. The fluid mixture dispensing system of claim 1, further comprising:

a cover for an opening of the cartridge receiver carriage;

wherein the fluid mixture dispensing system is further configured to:

detect that the cover is closed; and automatically trigger the actuator to depress the cartridge towards the interface surface upon detecting that the cover is closed.

13. The fluid mixture dispensing system of claim 1, wherein:

the actuator is located on a back side of the cartridge receiver carriage; and the actuator is attached to at least one pivoting arm.

14. A method of loading a cartridge in a fluid mixture dispensing device comprising:

receiving the cartridge in a cartridge receiver carriage of the fluid mixture dispensing device, wherein the cartridge comprises a set of protrusions on a bottom side;

depressing the cartridge receiver carriage towards an interface surface of the fluid mixture dispensing device to load the cartridge, wherein the interface surface comprises a set of recesses, and the set of protrusions and the set of recesses serve as a set of alignment features;

applying continuous downward pressure on the cartridge towards the interface surface when the cartridge is loaded and in contact with the interface surface; and horizontally aligning the cartridge, as the cartridge is pressed towards the interface surface when the cartridge is loaded, using the set of alignment features.

15. The method of claim 14, wherein:

the cartridge has a weight when filled; and the continuous downward pressure exceeds the weight of the cartridge.

16. The method of claim 14, further comprising:

sensing, using at least one sensor, the continuous downward pressure applied on the cartridge; and updating the continuous downward pressure applied on the cartridge based on a measurement of the at least one sensor.

17. The method of claim 14, wherein:

the interface surface comprises a set of upward actuators, configured to apply an upward force towards the cartridge when the cartridge is loaded, and configured to seal a set of orifices on the cartridge when the cartridge is loaded; and the continuous downward pressure applied on the cartridge towards the interface surface when the cartridge is loaded depends on at least on one of: (i) a number of upward actuators in the set of upward actuators; and (ii) the upward force applied by the set of upward actuators towards the cartridge.

18. The method of claim 14, wherein:

the continuous downward pressure applied on the cartridge towards the interface surface when the cartridge is loaded is equivalent to a weight in a range of 9-13 kilograms.

19. The method of claim 14, further comprising:

detecting that the cartridge is placed in the cartridge receiver carriage; and automatically depressing, after the detecting, the cartridge receiver carriage towards the interface surface to load the cartridge.

20. The method of claim 14, further comprising:

receiving an external force applied manually to the cartridge receiver carriage; and depressing the cartridge receiver carriage towards the interface surface to load the cartridge in response to the external force.

21. The method of claim 14, wherein:

the cartridge receiver carriage is depressed towards the interface surface to load the cartridge in a substantially vertical direction.

22. The method of claim 14, wherein:

the cartridge receiver carriage comprises a first set of alignment features; and the method further comprises:

horizontally aligning the cartridge with a first degree of precision, along the cartridge receiver carriage as the cartridge is inserted into the cartridge receiver carriage, using the first set of alignment features.

23. The method of claim 22, wherein:

the cartridge comprises a second set of alignment features, wherein the second set of alignment features comprise the set of protrusions; and the method further comprises:

horizontally aligning the cartridge, with a second degree of precision, as the cartridge is pressed towards the interface surface when the cartridge is loaded, using the second set of alignment features;

wherein the first degree of precision is less than the second degree of precision.

24. The method of claim 14, further comprising:

detecting an appropriate placement of the cartridge inside the cartridge receiver carriage; and allowing depression the cartridge towards the interface surface when the cartridge is in the appropriate placement.

25. The method of claim 14, further comprising:

detecting that a cover for an opening of the cartridge receiver carriage is closed; and automatically triggering the depressing of the cartridge towards the interface surface upon detecting that the cover is closed.

26. The method of claim 14, wherein:

the depressing is performed using an actuator;

the actuator is located on a back side of the cartridge receiver carriage; and the actuator is attached to at least one pivoting arm.

27. A fluid mixture dispensing system comprising:

an interface surface;

a cartridge receiver slot for a cartridge loader;

an actuator configured to depress a cartridge towards the interface surface to load a cartridge after the cartridge is inserted into the cartridge receiver slot;

a movable cover for the cartridge receiver slot; and a fluid path from the cartridge to an output of the fluid mixture dispensing system;

wherein the movable cover includes at least a portion of the fluid path.

28. The fluid mixture dispensing system of claim 27, wherein:

the fluid mixture dispensing system is configured to apply continuous downward pressure on the cartridge towards the interface surface when the cartridge is loaded and is in contact with the interface surface.

29. A fluid mixture dispensing system comprising:

an interface surface;

a cartridge receiver carriage;

an actuator configured to depress the cartridge receiver carriage towards the interface surface to load a cartridge; and at least one sensor configured to sense a continuous downward pressure applied on the cartridge;

wherein the fluid mixture dispensing system is configured to apply the continuous downward pressure on the cartridge towards the interface surface when the cartridge is loaded and is in contact with the interface surface; and wherein the fluid mixture dispensing system is further configured to update the continuous downward pressure applied on the cartridge based on a measurement of the at least one sensor.

30. A fluid mixture dispensing system comprising:

an interface surface;

a cartridge receiver carriage;

an actuator configured to depress the cartridge receiver carriage towards the interface surface to load a cartridge; and a set of upward actuators in the interface surface, configured to apply an upward force towards the cartridge when the cartridge is loaded, and configured to seal a set of orifices on the cartridge when the cartridge is loaded;

wherein fluid mixture dispensing system is configured to apply a continuous downward pressure on the cartridge towards the interface surface when the cartridge is loaded and is in contact with the interface surface, and the continuous downward pressure applied on the cartridge towards the interface surface when the cartridge is loaded depends on at least on one of: (i) a number of upward actuators in the set of upward actuators; and (ii) the upward force applied by the set of upward actuators towards the cartridge.

31. A fluid mixture dispensing system comprising:

an interface surface;

a cartridge receiver carriage;

an actuator configured to depress the cartridge receiver carriage towards the interface surface to load a cartridge;

a first set of alignment features; and a second set of alignment features;

wherein: (i) the fluid mixture dispensing system is configured to apply a continuous downward pressure on the cartridge towards the interface surface when the cartridge is loaded and is in contact with the interface surface; (ii) the first set of alignment features are in the cartridge receiver carriage; (iii) the first set of alignment features are adapted to horizontally align the cartridge, with a first degree of precision, along the cartridge receiver carriage as the cartridge is inserted into the cartridge receiver carriage; (iv) the second set of alignment features are adapted to horizontally align the cartridge, with a second degree of precision, as the cartridge is pressed towards the interface surface when the cartridge is loaded; and (v) the first degree of precision is less than the second degree of precision.

32. A method of loading a cartridge in a fluid mixture dispensing device comprising:

receiving the cartridge in a cartridge receiver carriage of the fluid mixture dispensing device;

depressing the cartridge receiver carriage towards an interface surface of the fluid mixture dispensing device to load the cartridge;

applying continuous downward pressure on the cartridge towards the interface surface when the cartridge is loaded and in contact with the interface surface;

sensing, using at least one sensor, the continuous downward pressure applied on the cartridge; and updating the continuous downward pressure applied on the cartridge based on a measurement of the at least one sensor.

33. A method of loading a cartridge in a fluid mixture dispensing device comprising:

receiving the cartridge in a cartridge receiver carriage of the fluid mixture dispensing device;

depressing the cartridge receiver carriage towards an interface surface of the fluid mixture dispensing device to load the cartridge; and applying continuous downward pressure on the cartridge towards the interface surface when the cartridge is loaded and in contact with the interface surface;

wherein: the interface surface comprises a set of upward actuators, configured to apply an upward force towards the cartridge when the cartridge is loaded, and configured to seal a set of orifices on the cartridge when the cartridge is loaded; and the continuous downward pressure applied on the cartridge towards the interface surface when the cartridge is loaded depends on at least on one of: (i) a number of upward actuators in the set of upward actuators; and (ii) the upward force applied by the set of upward actuators towards the cartridge.

34. A method of loading a cartridge in a fluid mixture dispensing device comprising:

receiving the cartridge in a cartridge receiver carriage of the fluid mixture dispensing device, wherein the cartridge receiver carriage comprises a first set of alignment features and the cartridge comprises a second set of alignment features;

depressing the cartridge receiver carriage towards an interface surface of the fluid mixture dispensing device to load the cartridge;

horizontally aligning the cartridge with a first degree of precision, along the cartridge receiver carriage as the cartridge is inserted into the cartridge receiver carriage, using the first set of alignment features;

horizontally aligning the cartridge, with a second degree of precision, as the cartridge is pressed towards the interface surface when the cartridge is loaded, using the second set of alignment features, wherein the first degree of precision is less than the second degree of precision; and applying continuous downward pressure on the cartridge towards the interface surface when the cartridge is loaded and in contact with the interface surface.

* * * * *